US008957294B2

(12) United States Patent
Toyonaga

(10) Patent No.: US 8,957,294 B2
(45) Date of Patent: Feb. 17, 2015

(54) CHINREST COVER FOR A MUSICAL INSTRUMENT

(71) Applicant: Shiho Toyonaga, Chicago, IL (US)

(72) Inventor: Shiho Toyonaga, Chicago, IL (US)

( * ) Notice: Subject to any disclaimer, the term of this patent is extended or adjusted under 35 U.S.C. 154(b) by 0 days.

(21) Appl. No.: 14/029,579

(22) Filed: Sep. 17, 2013

(65) Prior Publication Data

US 2014/0076122 A1 Mar. 20, 2014

Related U.S. Application Data

(60) Provisional application No. 61/701,901, filed on Sep. 17, 2012.

(51) Int. Cl.
*G10D 9/00* (2006.01)
*G10D 3/18* (2006.01)

(52) U.S. Cl.
CPC ..... *G10D 3/18* (2013.01)
USPC ..... 84/453

(58) Field of Classification Search
USPC ..... 84/279, 267
See application file for complete search history.

(56) References Cited

U.S. PATENT DOCUMENTS 2,524,526 A 10/1950 Hines
3,979,993 A * 9/1976 Proctor ..... 84/327
4,719,835 A * 1/1988 Biasini et al. ..... 84/279
5,919,470 A 7/1999 Valdez et al.
6,623,751 B2 9/2003 Gueret
7,371,396 B2 5/2008 Ghisalberti
7,625,575 B2 12/2009 Wagoner
2001/0007671 A1 7/2001 Gueret
2003/0175333 A1 9/2003 Shefer et al.
2005/0008665 A1 1/2005 Batzer et al.
2005/0100621 A1 5/2005 Popp et al.
2005/0112153 A1 5/2005 Wagoner
2006/0264505 A1 11/2006 Popp et al.
2007/0280898 A1 12/2007 Riddle
2008/0138451 A1 6/2008 Wagoner

FOREIGN PATENT DOCUMENTS

CN 201788666 U * 4/2011 ..... 84/279

OTHER PUBLICATIONS

Basketter et al., Nickel, cobalt and chromium in consumer products a role in allergic contact dermatitis. Contact Dermatitis 1993, 2815-25.
Bork, Allergic contact dermatitis on a violinist's neck from para-phenylenediamine in a chinrest stain. Contact Dermatitis 1993, 28:250-251.
Buckley et al., 'Fiddler's fingers' violin-string dermatitis. Contact Dermatitis 1995, 3246-47.

(Continued)

*Primary Examiner* — Kimberly Lockett
(74) *Attorney, Agent, or Firm* — Sreenivasarao Vepachedu; Leslie B. Wilson; Cardinal Law Group LLC

(57) ABSTRACT

The invention is a protective cover for a musical instrument. The musical instrument comprises stringed instruments such as various models of violins and violas. Another embodiment of the invention is a protective cover for chinrest of a musical instrument, and methods of making and uses thereof.

15 Claims, 23 Drawing Sheets

(56) References Cited

OTHER PUBLICATIONS

Gambichler et al thesis-with-English-publication-Skin conditions in instrumental musicians: a self-reported survey, Contact Dermatitis 2008, 58:217-222.

Oga et al., Dystrophic calcinosis cutis in the skin below the mandible of a violinist. Br J Dermatol 1998, 139:940-941.

Önder et al., Skin problems of musicians. Intl J Dermatol 1999, 38:192-195.

Önder et al., Stress and skin diseases in musicians: evaluation of the beck depression scale, general psychologic profile (the brief symptom inventory [BSI]), beck anxiety scale and stressful life events in musicians. Biomed Pharmacother 2000, 32:311-315.

Rimmer et al., Dermatologic problems of musicians. J Am Acad Dermatol 1990, 22:657-663.

Tanaka et al., Contact dermatitis from nylon 6 in Japan. Contact Dermatitis, 1993, 28:250.

* cited by examiner

Fig 6
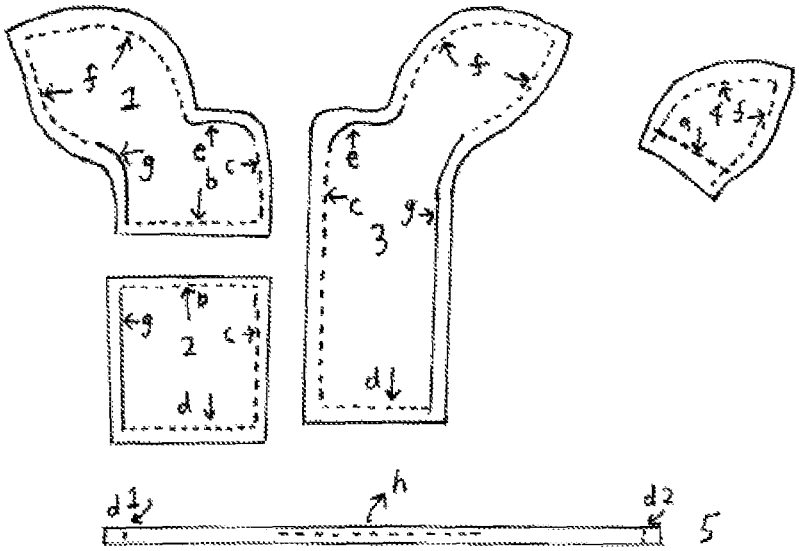
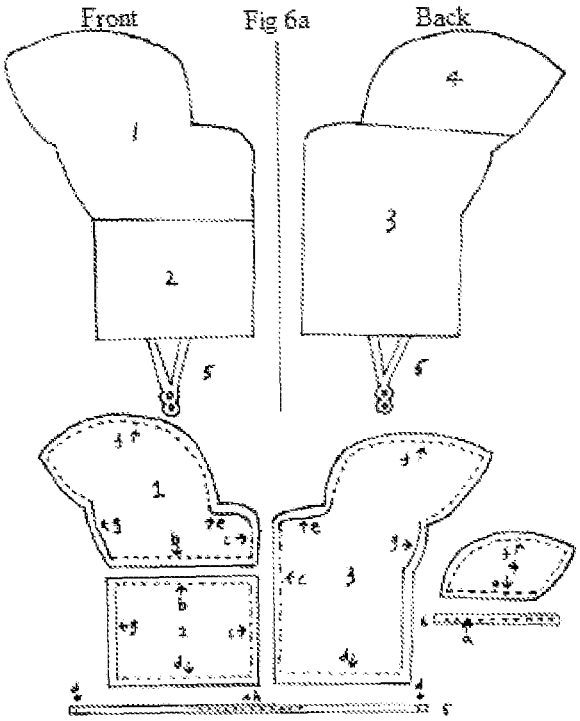
Fig 6a
Fig 6b

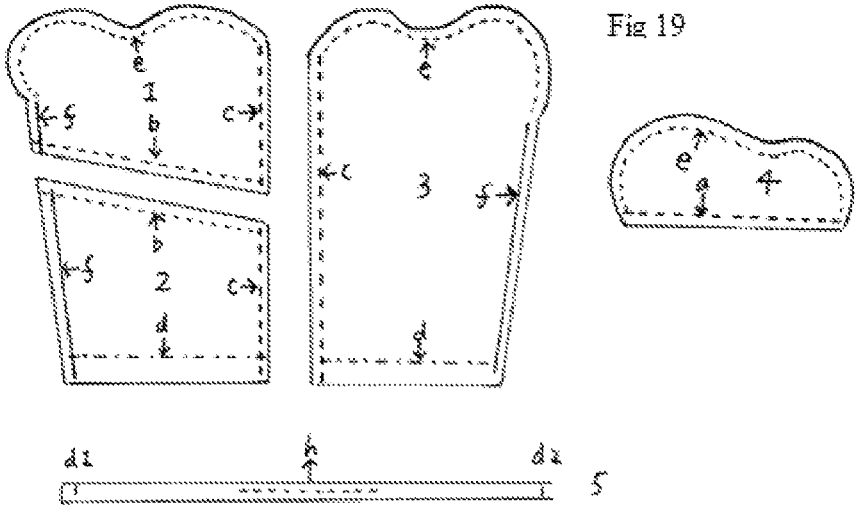
Fig 19
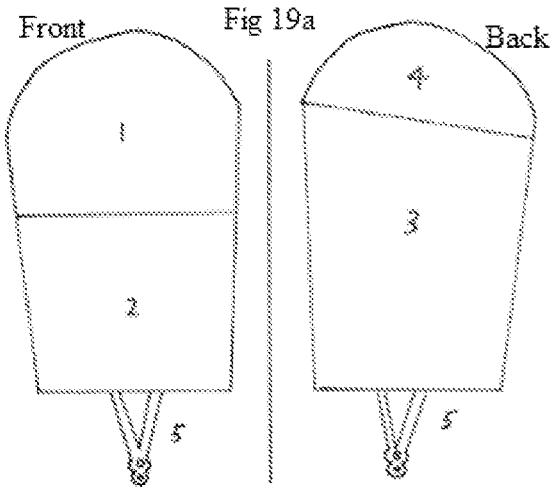
Fig 19a
Fig 19b
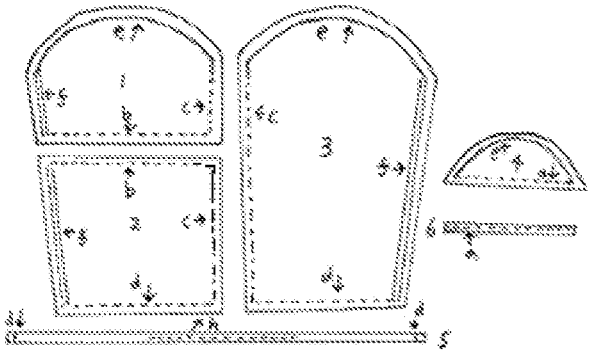

Fig 23
Fig 23a
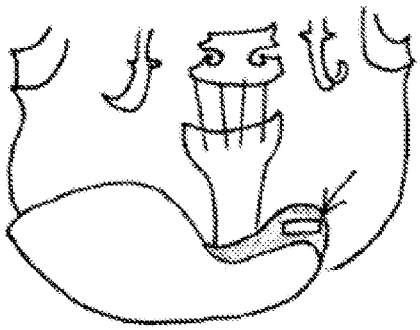
Fig 23b
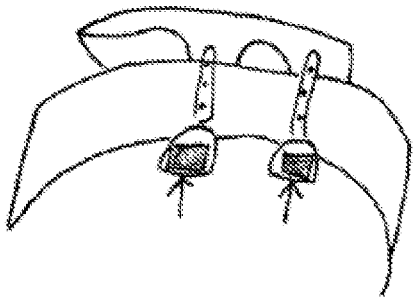
Fig 23c
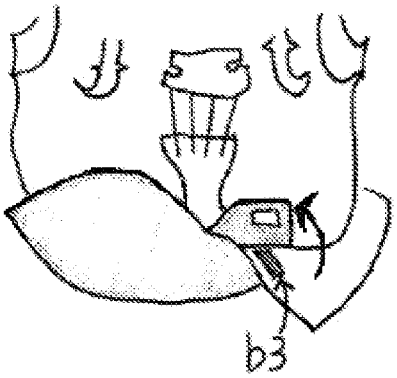
Fig 23d
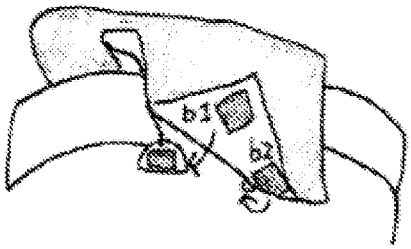

CHINREST COVER FOR A MUSICAL INSTRUMENT

CROSS-REFERENCE TO RELATED APPLICATIONS

This utility application claims the benefit of U.S. Provisional Application Ser. No. 61/701,901, filed on Sep. 17, 2012; which is incorporated herein by reference in its entirety for all purposes.

FIELD OF THE INVENTION

The present invention relates to accessories for musical instruments. More specifically, the invention relates to an attachment and cover for the chinrest of the instrument to protect the player's skin and chin.

BACKGROUND OF THE INVENTION

As music evolved throughout history the technological advancement of instruments and instrument accessories became essential for musicians to achieve mastery. Classical violin places a technical demand on musicians unlike any other instrument. The standard technique for classical violin is to hold the instrument horizontally at shoulder throughout performance, which creates physical strain on the neck and shoulder.

A chinrest (FIG. 1*a*-1*f*) is a device that was designed to help support the violinist in holding the instrument and reduce the strain. The chinrest is located on front panel of the instrument. It is clamped and mounted with metal columns with a connecting bar (or legs FIG. 2) extending to a back panel. A player places the back panel on his/her left collarbone and puts his/her chin on the chinrest. This contact point needs to be unmovable since both hands need to be free to hold the instrument and bow. Due to strong pressure, friction, and perspiration against the chinrest many players develop "Fiddler's neck." Severe skin allergies have been known to develop from continued exposure to the metal attachment and exotic woods of the chinrest.

In order to prevent these conditions handkerchiefs have been used to cover chinrests. However, they are unstable and fall off from the chinrest and are unsuitable for performance. Currently there are ineffective pads, cushions, and covers for chinrests. But, these designs are not compatible with various chinrest models.

There is a need for stable and protective covers for chinrests and the present invention covers and securely attaches to the chinrest providing protection and stability.

SUMMARY OF THE INVENTION

An embodiment of the invention is a protective cover for a musical instrument. The musical instrument comprises stringed instruments such as various models of violins and violas. The cover can be partial or complete.

In another embodiment, the protective cover is for chinrest of a musical instrument. The chinrest cover comprises a fabric. The fabric comprises synthetic or natural fabrics.

In another embodiment, the chinrest cover can be of various shapes and sizes depending upon the chinrest model and instrument size.

In another embodiment, the chinrest cover has a secure attachment and is made out of hypo-allergenic, anti-bacterial fabric for optimum dermatological health.

In another embodiment, the chinrest cover is machine washable and dryable for easy maintenance and reuse. In another embodiment the cover is disposable.

In another embodiment, the chinrest cover provides protection without obstructing the musical performance.

Another embodiment is a method of preventing or protecting, or treating body parts such as chin, lower jaw, neck and collar bone, and skin thereof from diseases, conditions or allergies. Another embodiment is a method of protecting the musical instrument or part thereof from deterioration.

Another embodiment is a method of making a chinrest cover.

BRIEF DESCRIPTION OF THE FIGURES

FIG. 6. Guarneri model chinrest cover parts and seam sequence.

FIG. 6*a*. Front and Back view of center mount left cup universal chinrest cover. 1 & 4. Bamboo fabric. 2 & 3. 100% cotton flannel fabric. 4. A pocket with cotton braid elastic edge into which chinrest cup inserts. 5. Machine dryable cotton braid elastic band with two loops in the center for length adjustment (FIG. 7, 8).

FIG. 6*b*. Center mount left cup universal chinrest cover parts and seam sequence.

Machine dryable cotton braid elastic band with hand sewn two loops in center for length adjustment (FIG. 7, 8).

Figure 11:
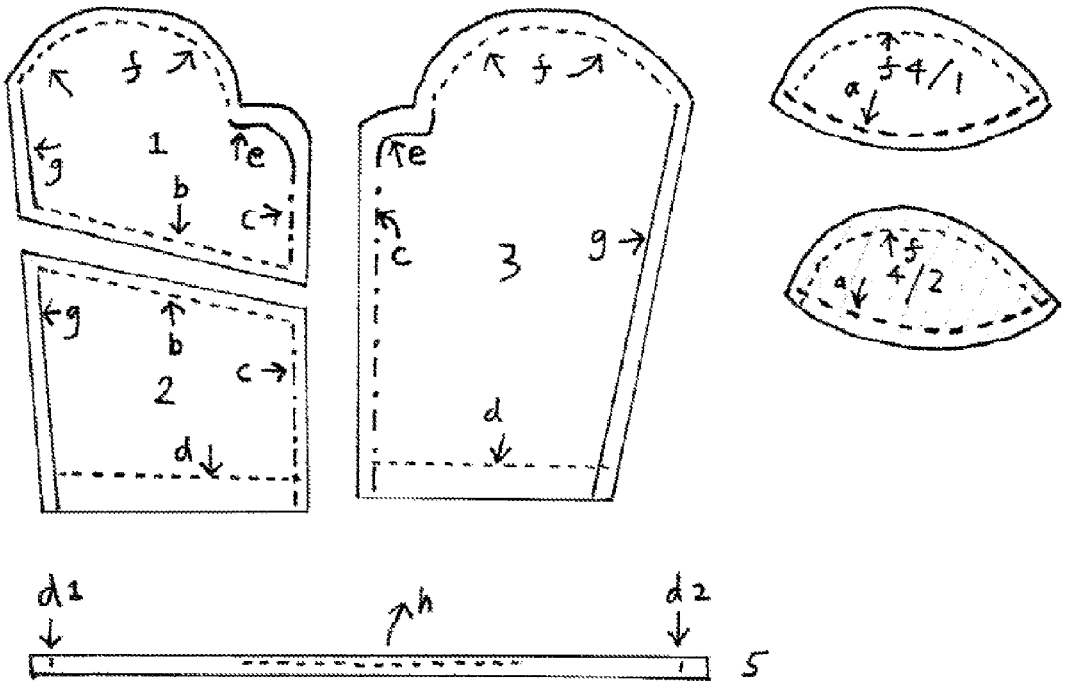

FIG. 11. Dresden model chinrest cover parts and seam sequence.

Figures 1A, 1B, 1C, 1D, 1E, 1F:
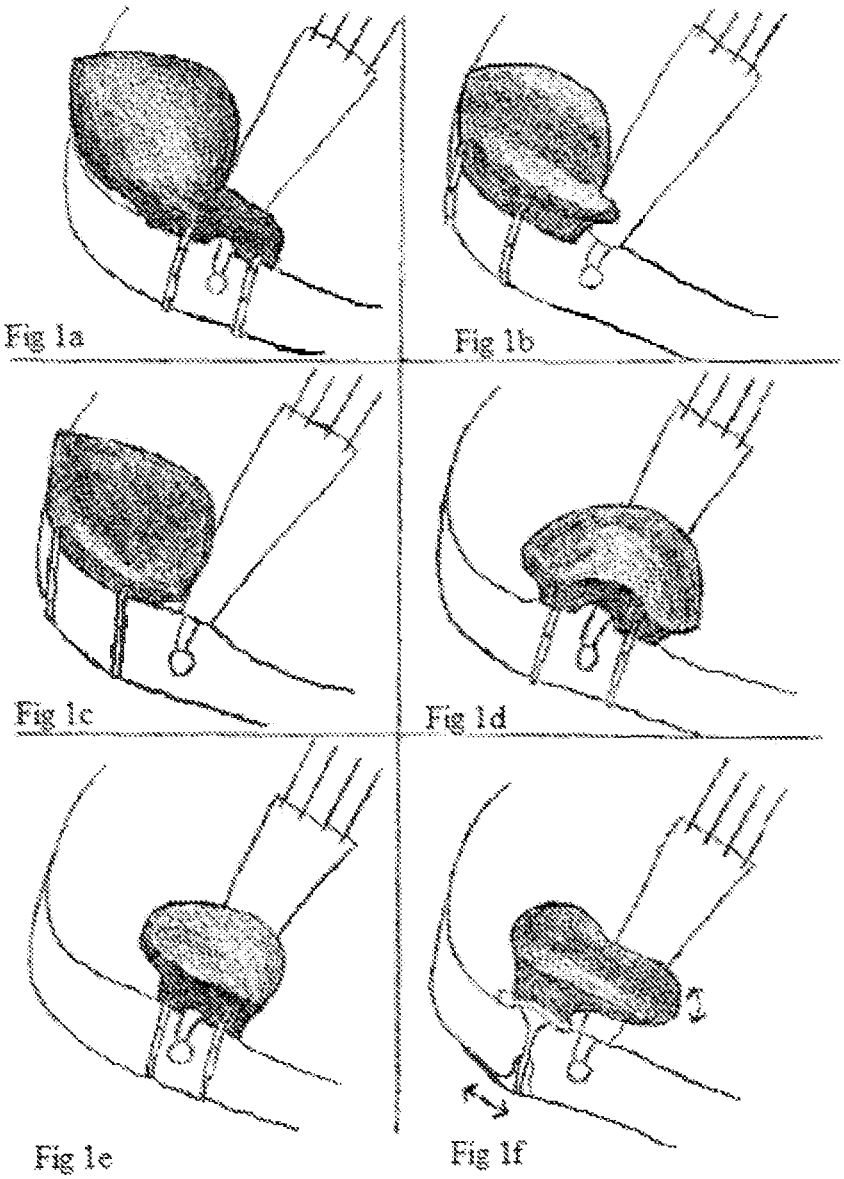
FIG. 1*a*. Guarneri model chinrest.
FIG. 1*b*. Dresden model chinrest.
FIG. 1*c*. Kaufman model chinrest.
FIG. 1*d*. Flesch model chinrest.
FIG. 1*e*. Paganini model chinrest. 1*f*. SAS model chinrest.
FIG. 1*f*. SAS model chinrest.
Figure 12:
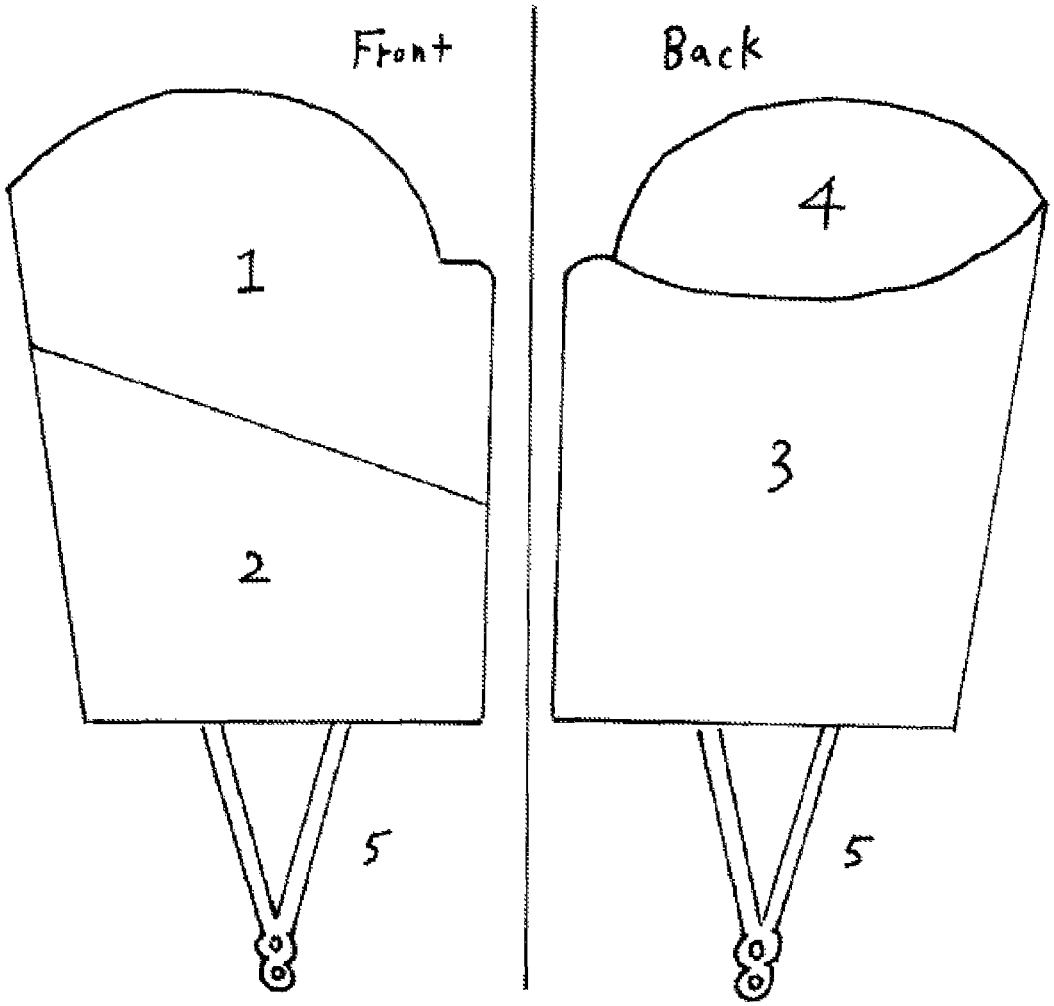

FIG. 12. Front and Back view of Kaufman model chinrest cover (FIG. 1*c*). 1. Bamboo fabric. 2-4. 100% cotton flannel fabric. 4. A pocket into which chinrest cup inserts. Oblong shape pocket has two layers to give more support (FIG. 13, 4/1, 4/2). 5. Machine dryable cotton braid elastic band with hand sewn two loops in center for length adjustment (FIG. 7, 8).

Figure 13:
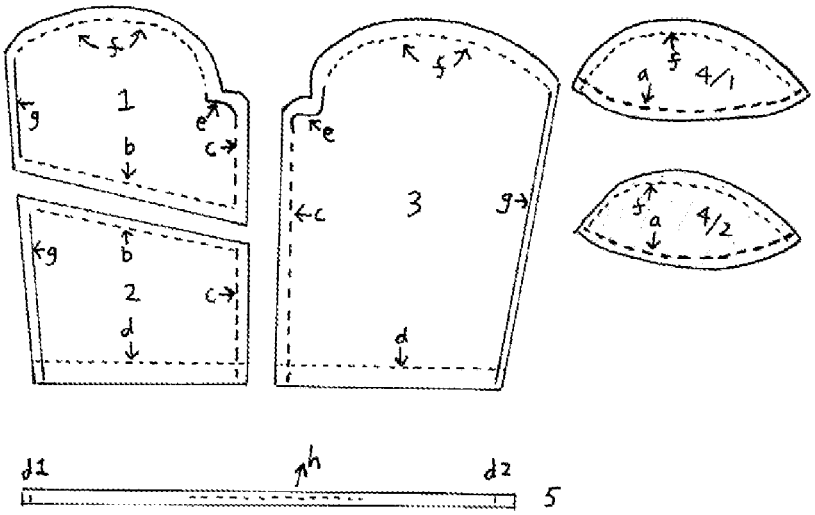

FIG. 13. Kaufman model chinrest cover parts and seam sequence.

Figure 13A:
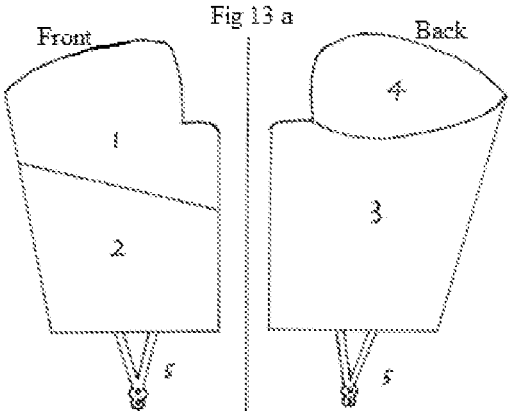

FIG. 13*a*. Left mount universal chinrest cover. 1 & 4. Bamboo fabric. 2 & 3. 100% cotton flannel fabric. 4. A pocket with cotton braid elastic edge into which chinrest cup inserts. 5. Machine dryable cotton braid elastic band with hand sewn two loops in center for length adjustment (FIG. 7, 8).

Figure 13B:
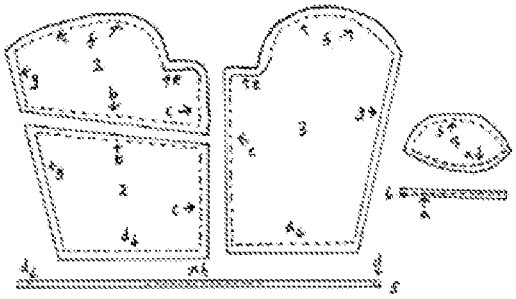

FIG. 13*b*. Left mount universal chinrest cover parts and seam sequence.

Figure 14:
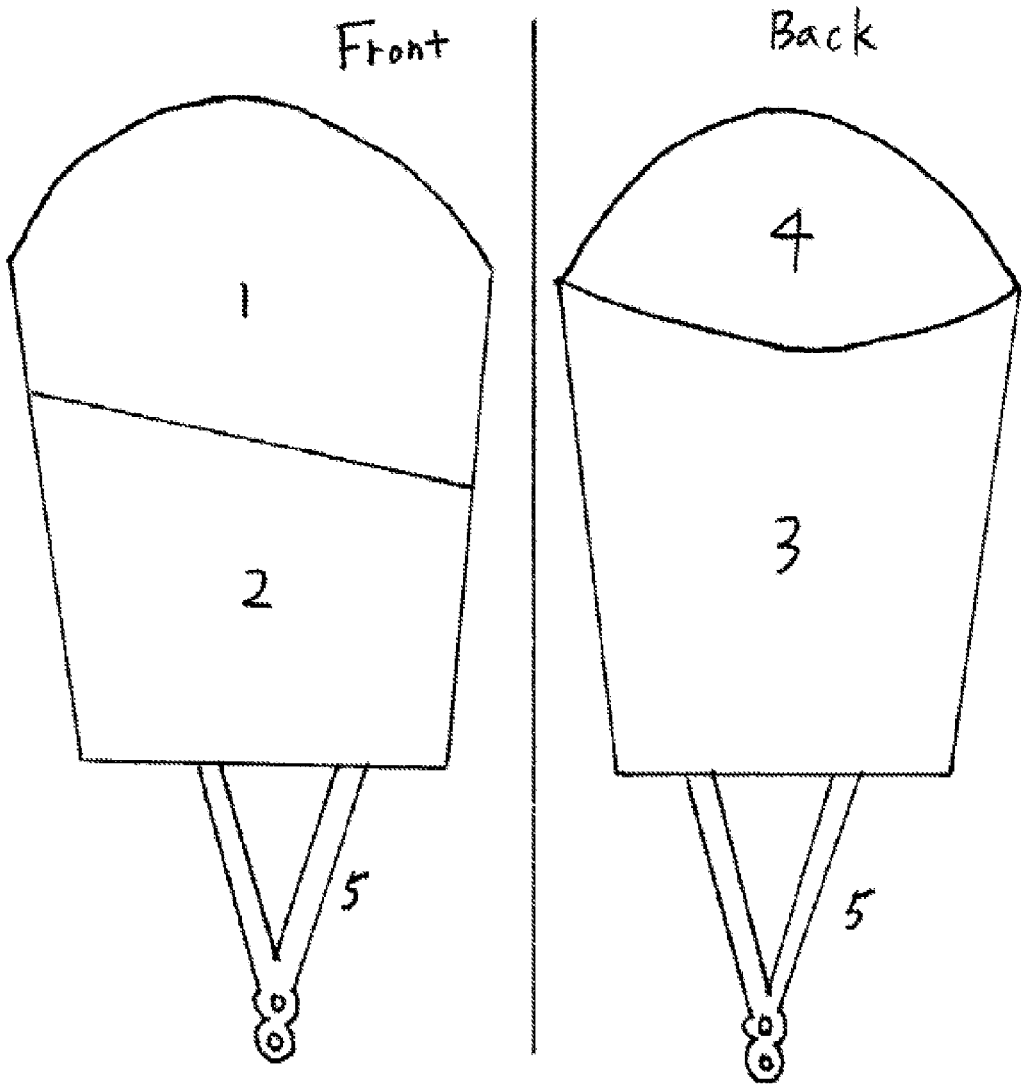

FIG. 14. Front and Back view of Flesch model chinrest cover (FIG. 1*d*). 1. Bamboo fabric. 2-4. 100% cotton flannel fabric. 4. A pocket into which chinrest cup inserts. 5. Machine dryable cotton braid elastic band with hand sewn two loops in center for length adjustment (FIG. 7,8).

Figure 15:
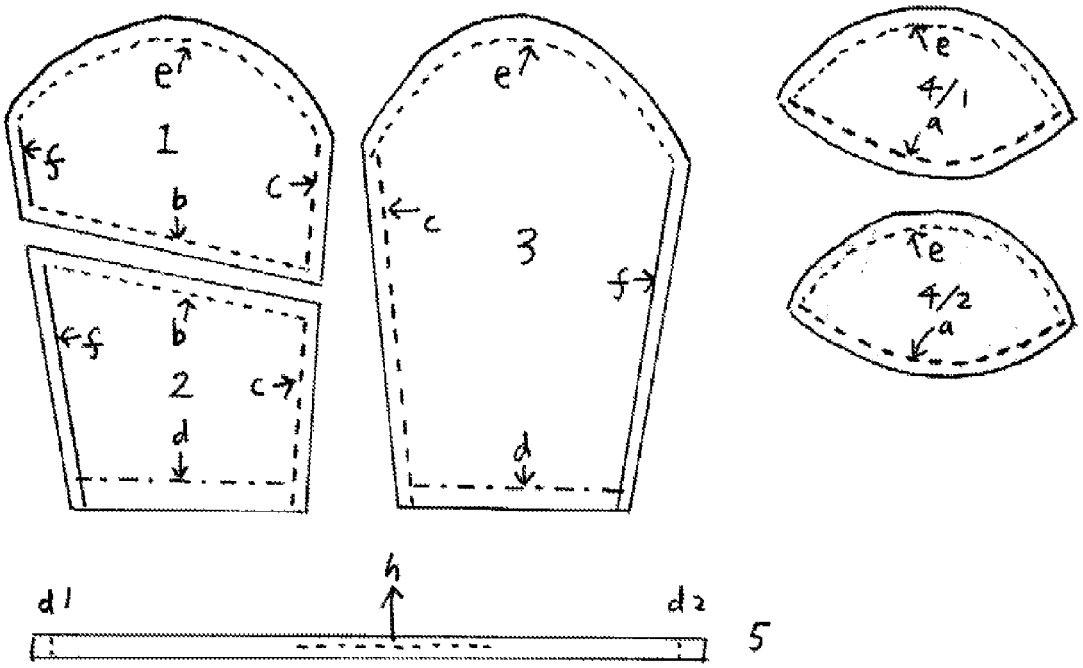

FIG. 15. Flesch model chinrest cover parts and seam sequence.

Figure 16:
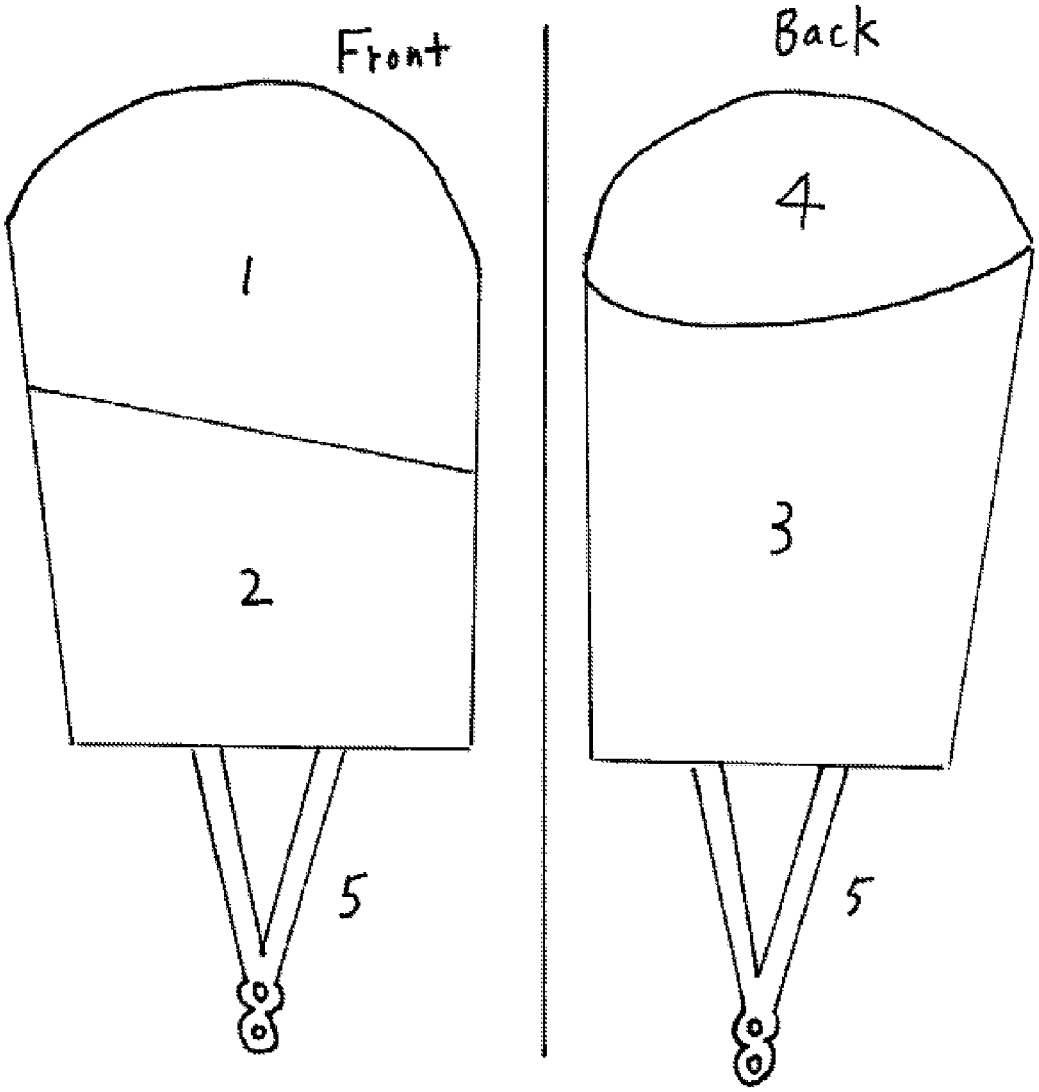

FIG. 16. Front and Back view of Paganini model chinrest cover (FIG. 1*e*). 1. Bamboo fabric. 2-4. 100% cotton flannel fabric. 4. A pocket into which chinrest cup inserts. 5. Machine dryable cotton braid elastic band with hand sewn two loops in center for length adjustment (FIG. 7, 8).

Figure 17:
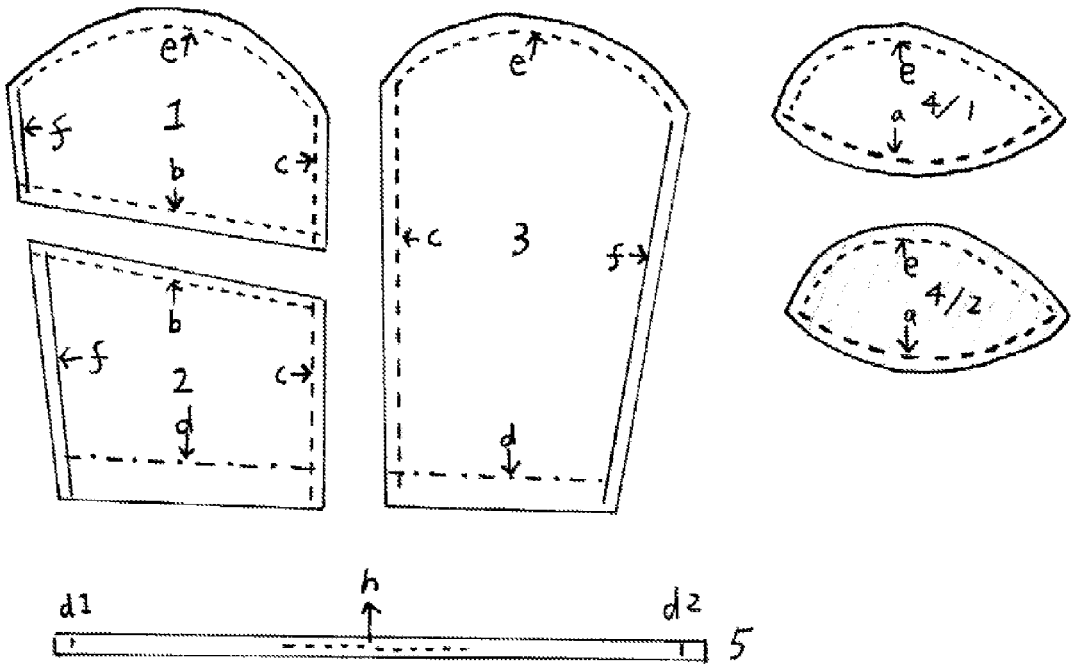

FIG. 17. Paganini model chinrest cover parts and seam sequence.

Figure 18:
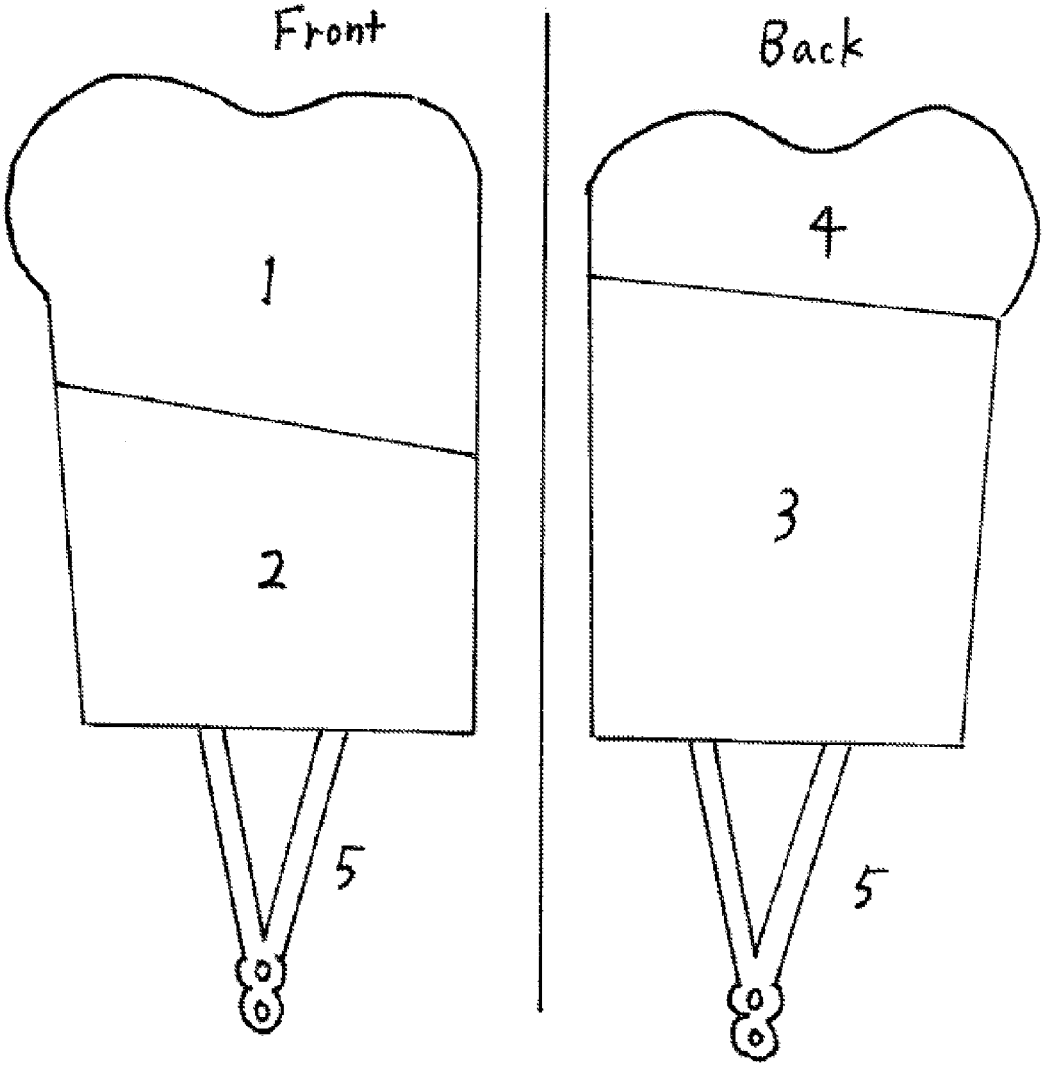

FIG. 18. Front and Back view of SAS model chinrest cover (FIG. 1*f*). 1. Bamboo fabric. 2-4. 100% cotton flannel fabric. 4. A pocket into which chinrest cup inserts. 5. Machine dryable cotton braid elastic band with hand sewn two loops in center for length adjustment (FIG. 7, 8).

FIG. 19. SAS model chinrest cover parts and seam sequence.

FIG. 19*a*. Center mount center cup universal chinrest cover. 1 & 4. Bamboo fabric. 2 & 3. 100% cotton flannel fabric. 4. A pocket with cotton braid elastic edge into which chinrest cup inserts. 5. Machine dryable cotton braid elastic band with hand sewn two loops in center for length adjustment (FIG. 7, 8).

FIG. 19*b*. Center mount center cup universal chinrest cover parts and seam sequence.

Figure 20:
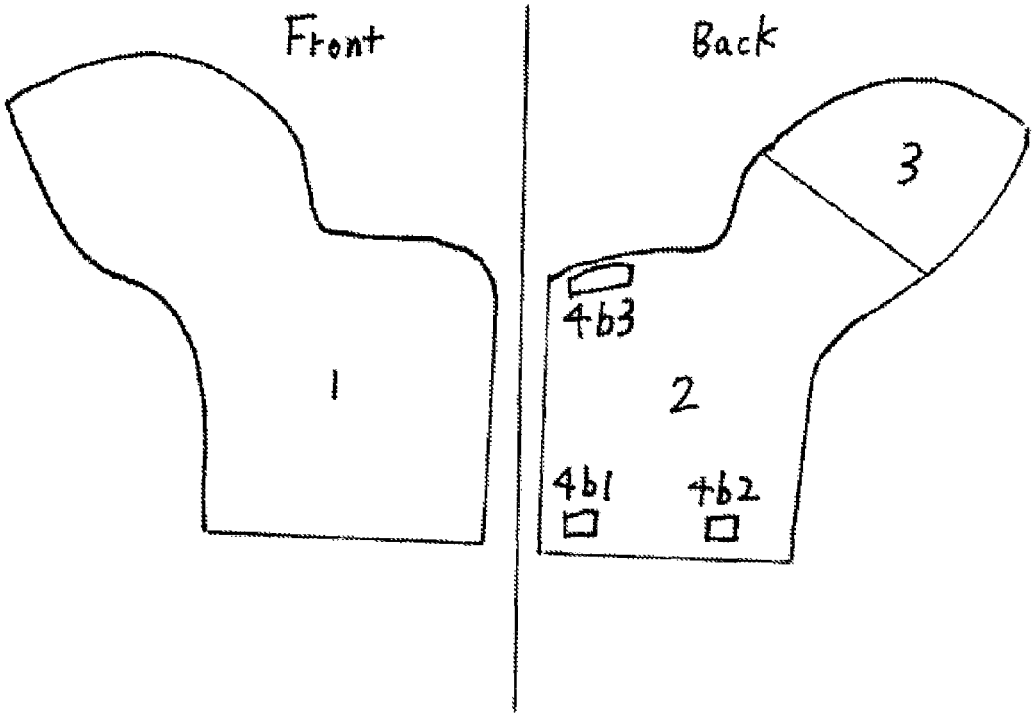

FIG. 20. Front and back view of Guarneri model chinrest cover with Velcro® attachment instead of elastic band (FIG. 7, 8). 1. Bamboo fabric. 2 and 3. 100% cotton flannel fabric. 3. A pocket into which chinrest cup inserts. 4 b1, 4 b2, 4 b3. "loops" side of Velcro® pieces are sewn onto 2.

Figure 21:
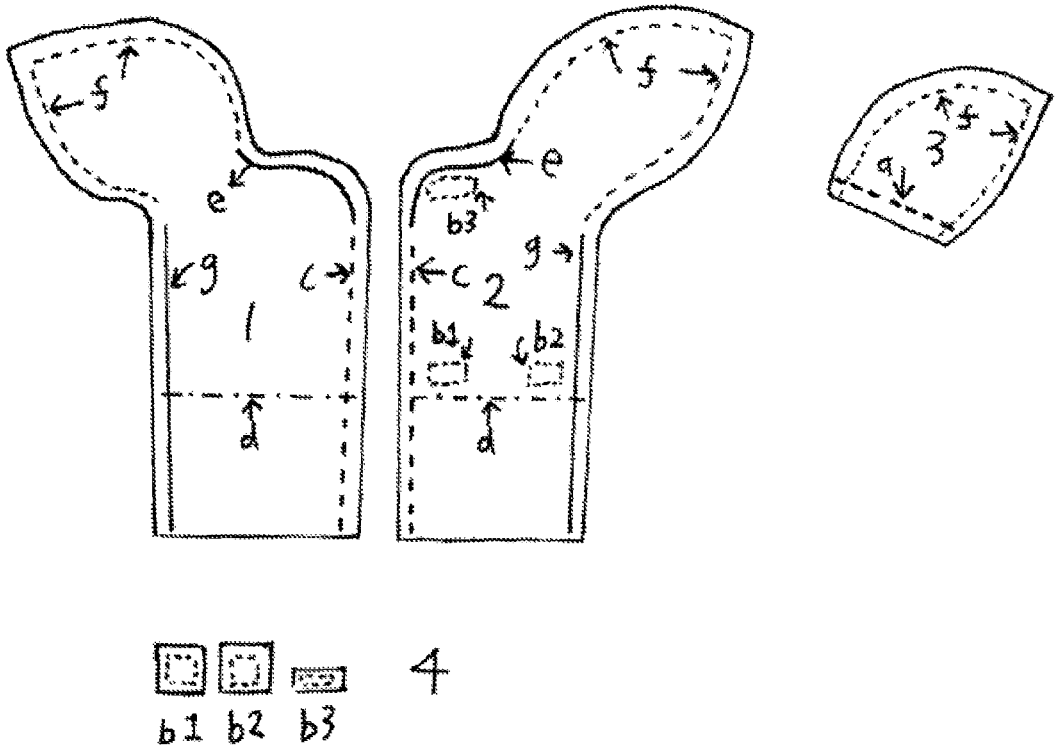

FIG. 21. Guarneri model chinrest cover with Velcro® attachment parts and seam sequence.

Figure 22:
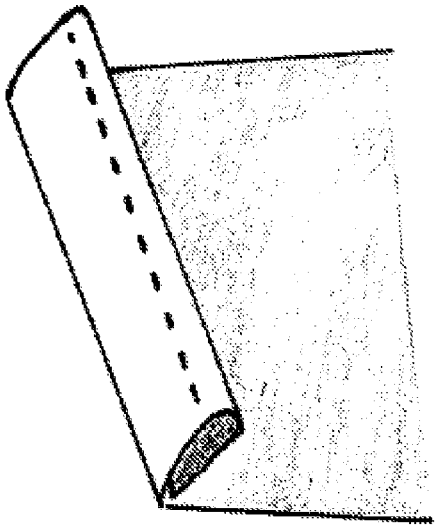

FIG. 22. The material on the edge of the chin pocket is folded twice prior to sewing to prevent shredding.

FIG. 23*a*. Adhesive Velcro® application on Guarneri chinrest's corner. "Hooks" side of Velcro® material is applied.

FIG. 23*b*. Adhesive Velcro® application on back of Hill style legs of Guarneri chinrest. "Hooks" side of Velcro® material is applied.

FIG. 23*c*. Guarneri model chinrest cover's top corner matches with opposite side Velcro® attachment of FIG. 23*a*.

FIG. 23*d*. Guarneri model chinrest cover's bottom matches with opposite side Velcro® attachment of FIG. 23*b*.

DETAILED DESCRIPTION OF THE INVENTION

An embodiment of the invention is a protective cover for a device, equipment, protective gear or musical instrument. In one embodiment, the musical instrument comprises stringed instruments such as various models of violins and violas. The cover can be partial or complete.

In another embodiment the cover is a chinrest cover. Chinrest is part of an instrument or device that touches the chin for the purpose of support or hold for the instrument or device (FIG. 1*a*-1*f*).

In another embodiment, the chinrest cover is for a musical instrument, wherein the musical instrument is violin or viola.

The chinrest cover comprises a fabric. The fabric is selected from synthetic, natural fabrics, or a combination thereof.

Figure 2A:
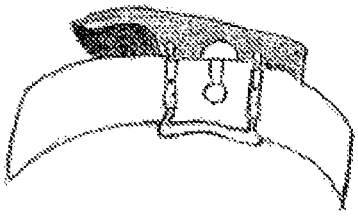
FIG. 2*a*. Chinrest columns and a bar.
Figure 2B:
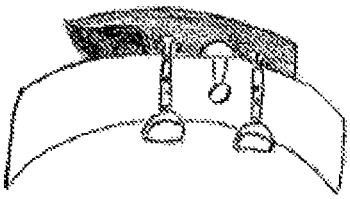
FIG. 2*b*. Chinrest columns and Hill style legs.
Figure 3:
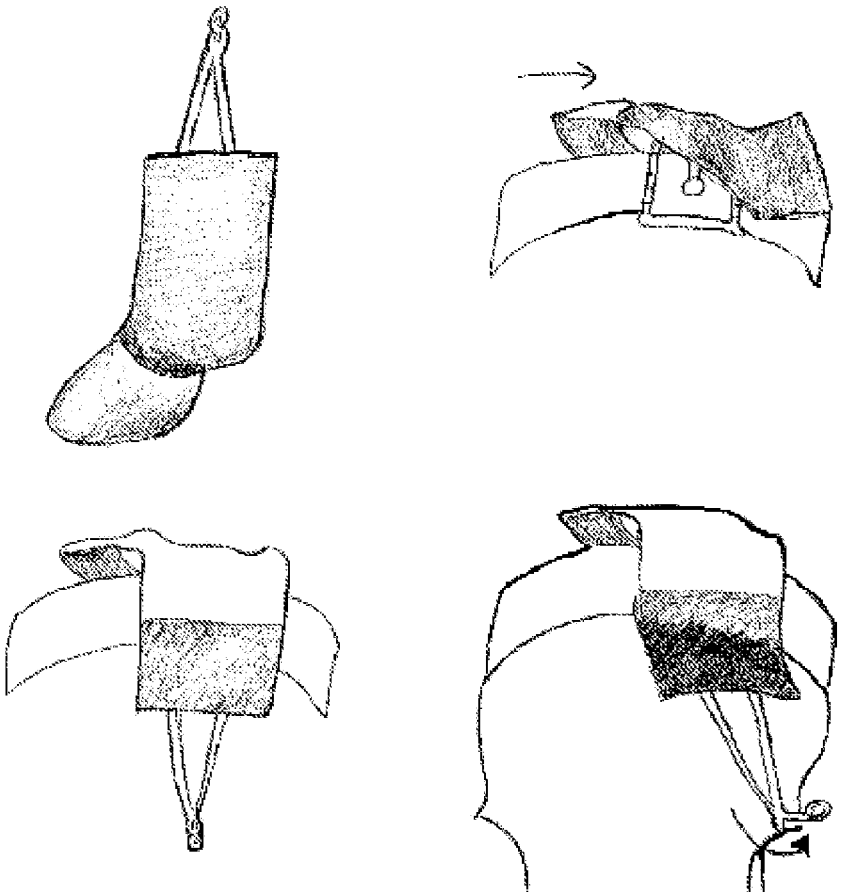
FIG. 3. A chinrest cover and its attachment steps
Figure 4A:
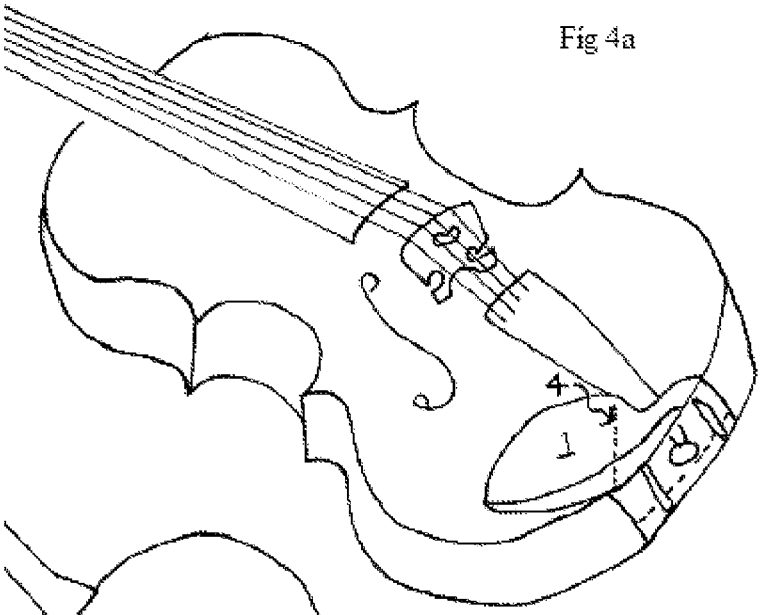
FIG. 4*a*. Front view of Guarneri model chinrest cover on an instrument (FIG. 1*a*). Guarneri model has two columns with a connecting bar (or legs FIG. 2*a*, 2*b*) that mount over the tail piece. Front side of chinrest cover, 1 is bamboo fabric and back side, 4 is a pocket into which chinrest cup inserts (FIG. 5).
Figure 4B:
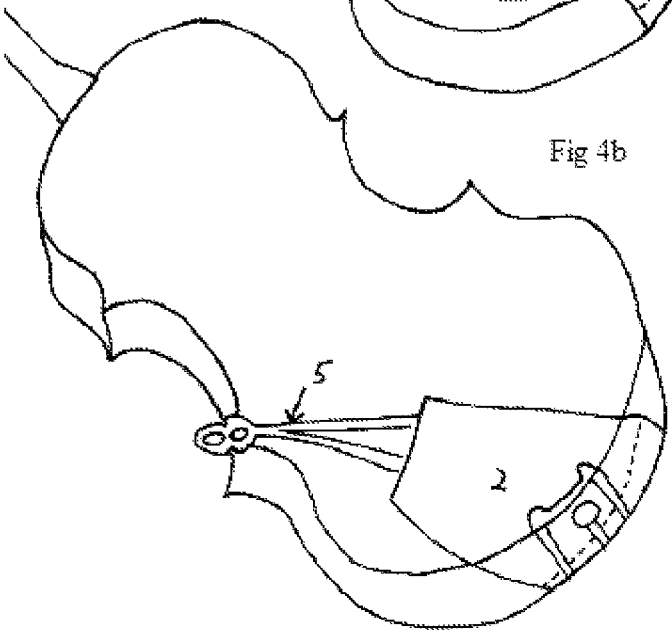
FIG. 4*b*. Back view of Guarneri model chinrest cover on an instrument. 2 is front bottom part of the cover. 5 is cotton braid elastic band with a two loop attachment (FIG. 5, 7, 8).
Figure 5:
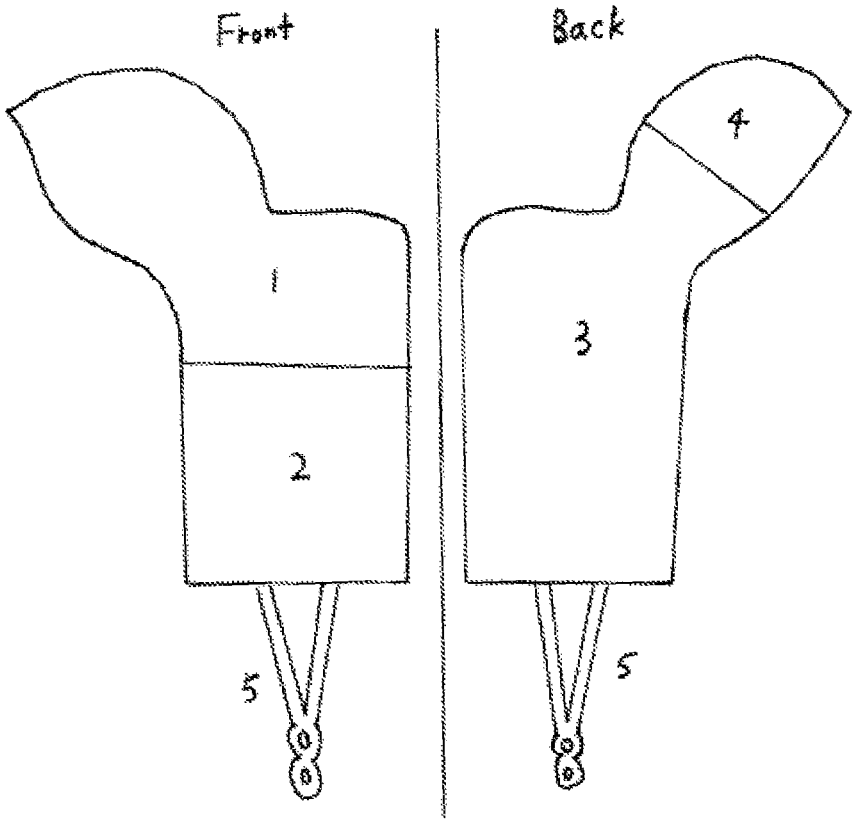
FIG. 5. Front and Back view of Guarneri model chinrest cover. 1. Bamboo fabric. 2-4. 100% cotton flannel fabric. 4. A pocket into which chinrest cup inserts. 5. Machine dryable cotton braid elastic band with two loops in the center for length adjustment (FIG. 7, 8).
Figure 8A:
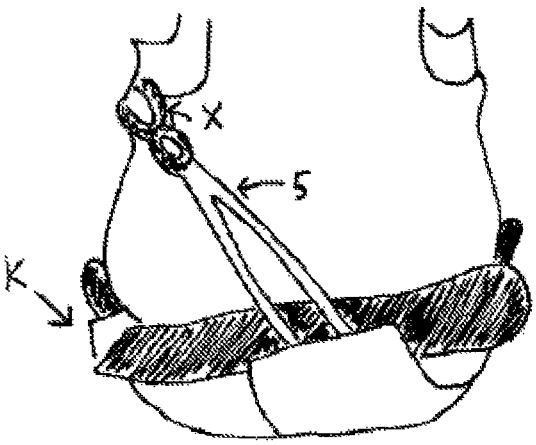
FIG. 8*a*. Chinrest cover reaches over the shoulder rest with attachment loop x.
Figure 8B:
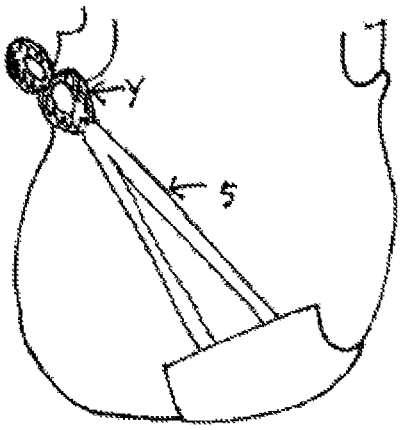
FIG. 8*b*. Chinrest cover attached by loop y.
Figure 9A:
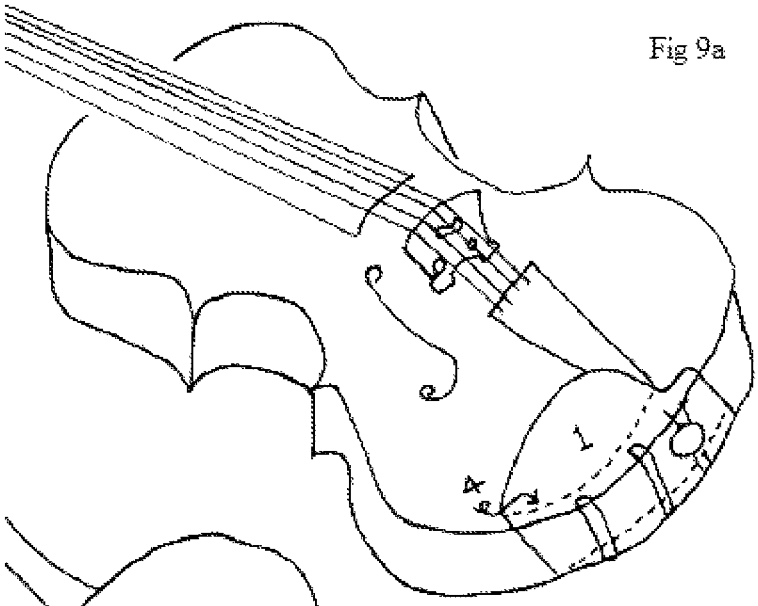
FIG. 9*a*. Front view of Dresden model chinrest cover on an instrument (FIG. 1*b*). Dresden model has two columns with a connecting bar (or legs FIG. 2) that mount on the left side of the tail piece. Front side of chinrest cover, 1 is bamboo fabric and back side, 4 is a pocket into which chinrest cup inserts (FIG. 10).
Figure 9B:
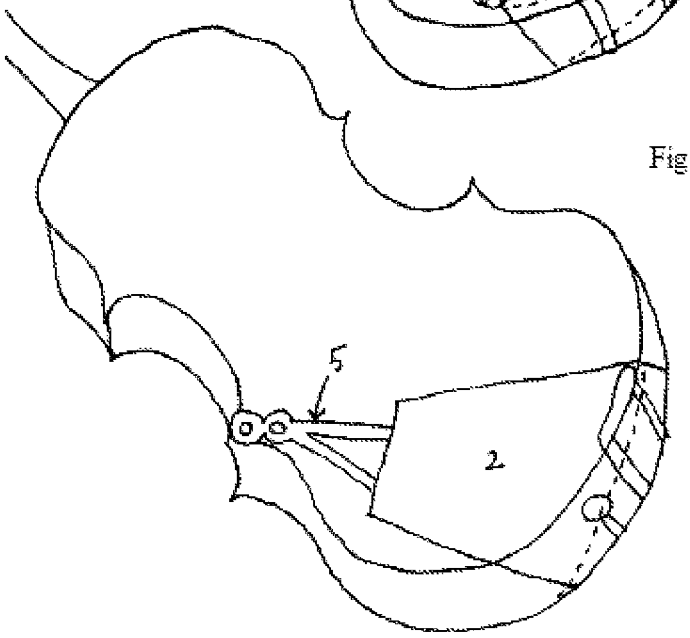
FIG. 9*b*. Back view of Dresden model chinrest cover on an instrument. 2 is front bottom part of the cover. 5 is cotton braid elastic band with a two loop attachment (FIG. 10, 7, 8).
Figure 10:
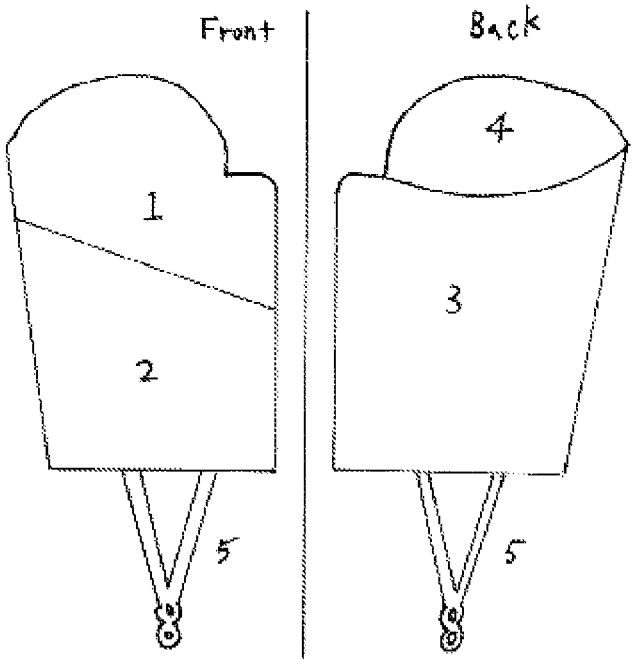
FIG. 10. Front and Back view of Dresden model chinrest cover. 1. Bamboo fabric. 2-4. 100% cotton flannel fabric. 4. A pocket into which chinrest cup inserts. Oblong shape pocket has two layers to give more support (FIG. 11, 4/1, 4/2). 5.

In another embodiment, the fixed attachment (FIG. 3, 8, 23) enables performers to alternate between playing and non playing positions with ease. More than fifty models of chinrests have been designed since Louis Spohr's invention in the early nineteenth century. Twenty models are commonly used today. One of the most popular is the "Guarneri" model (FIG. 1*a*, 4, 5, 6, 20, 21, 23). It is recognized for its medium height support and "teardrop shape" cup. A metal attachment comprised of columns and a bar (or legs) (FIG. 2), is centered over the tailpiece with the chin cup to the left side. Another model either Dresden (FIG. 1*b*, 9, 10, 11) or Kaufman (FIG. 1*c*, 12, 13) uses a lower support that has a rounded "oblong shape" cup. The columns and a bar (or legs) of these models are attached on the left side of the tailpiece. Unlike the Guarneri model the metal parts of these chinrests are further away from the tailpiece. All of these models are usually used with a supporting device called a "shoulder rest" (FIG. 8*a k*). The shoulder rest attaches to the back panel of the violin. It provides additional leverage from underneath instrument. Some players prefer not to use a shoulder rest. Flesch (FIG. 1*d*, 14, 15), Paganini (FIG. 1*e*, 16, 17) and SAS (FIG. 1*f*, 18, 19) are chinrests that provide support without the need of a shoulder rest. Their chin cups are higher than previously mentioned models. Columns and a bar or legs of Flesch and Paganini models are centered over the tailpiece, whereas SAS's single column is adjustable for its location and its tilt. The preference among the Guarneri, Dresden, Kaufman, Flesh, Paganini and SAS models depends on each player's body structure such as the neck length, width, and jaw line. The present invention has variations in design that accommodate the Guarneri, Dresden, Kaufman, Flesch, Paganini, SAS and commercially available models in various sizes of violins and violas. The chinrest cover covers all the exposed parts of the chinrest that are in contact with the skin. Yet, it contacts minimum surface area on the back panel of the instrument which allows optimal vibration for sound production, and protects the skin of the player.

Another aspect of the invention is to protect the instrument from deterioration and discoloration. Most players are concerned about preventable damage to their instrument from perspiration and/or facial cosmetic products. Perspiration could moisten and discolor varnish which could lead to an opening of seam of wooden panels where chinrest is mounted.

In another embodiment, the chinrest cover is designed to accommodate commercially available chinrest described above having various shapes, including but not limited to, teardrop, oblong, bean, or half moon. There are three universal designs available for left mount, center mount left cup, center mount chinrest models. Accordingly, the chinrest cover has a secure attachment and is made out of hypo-allergenic, anti-bacterial fabric for optimum dermatological health.

Another embodiment of the invention is a protective cover for chinrest of a musical instrument. The chinrest cover comprises a fabric. The fabric comprises synthetic or natural fabrics. The fabrics that can be used in the present invention include a group of textiles consisting of acrylic, cotton, polyester, rayon, ramie, nylon, silk, acetate, wool, bamboo, flax, polyester/cotton blends, wool/polyester blends, polyester/cotton/spandex blends, bamboo/cotton blends, bamboo/spandex blends, bamboo/rayon blends, bamboo/cotton/rayon blends, bamboo/cotton/spandex blends, bamboo/rayon/spandex blends.

In one embodiment, the fabric is obtained from organic produce, grown using eco-conscious methods, without toxic pesticides or fertilizers.

In another embodiment, the invention is made of fabric comprising bamboo fabric and/or cotton. The bamboo fabric, which is in direct contact with the skin is an anti bacterial material and provides dermatological benefit.

Bamboo contains a natural and unique agent called "bamboo kun" which is a shield against pathogens. Unlike other types of fabric where chemical antimicrobial agents are used, bamboo fabric products do not need or use these chemicals, which can cause skin irritations and allergic reactions. A quantitative antibacterial capability test was performed by the China Industrial Testing Center (CTITC) from Jul. 7, 2003 through Jul. 11, 2003. One hundred percent Bamboo Fabric was tested over a 24-hour incubation period with bacterial strain type *Staphylococcus aureous*. After the 24-hour period the numbers of live bacteria were counted in each sample. The results showed that 100% bamboo fabric exhibits 99.8% antibacterial kill rate. Studies by the Japan Textile Inspection Association (JTIA) revealed long-term antibacterial efficacy of bamboo fabric. The quantitative test method JISL 1902 was performed using 100% bamboo fabric that had been washed industrially 50 times. Incubation over a 24-hour period with bacterial strain type MRSA *Staphylococcus* IID 1677 was followed by a count of live bacteria on each sample. Results showed that bamboo fabric showed antibacterial efficacy greater than 70% after 50 industrial washings (Shanghai Tenbro Bamboo Textile Ltd).

In an embodiment of the invention, the cover made of fabric comprising bamboo fabric promotes optimum bacterial protection.

In another embodiment, the chinrest cover comprises additives. The additives can be natural or synthetic, and include, but not limited to, minerals, vitamins, cosmetics, dermatologicals, pharmaceuticals, and supplements. The additives can be incorporated before, during or after the fabric preparation and/or cover preparation. The additives are selected based on the need of the instrumentalist, the skin condition, required treatment and available additives useful the purpose, including, but not limited to, active pharmaceutaical ingredients, dermatological ingredients and cosmetics disclosed in U.S. Pat. No. 5,919,470 A,U.S. Pat. No. 7,625,575 B2, US 2005/0008665 A1, US 2006/0264505 A1, US 2005/010 0621 A1, US2007/0280898 A1, US2005/0112153 A1, US2008/0138451 A1, US2003/0175333 A1, US2005/0008665 A1, U.S. Pat. No. 6,623,751 B1, U.S. Pat. No. 7,371,396 B2, US2001/0007671 A1, which are incorporated herein by reference.

The present invention is compatible with modern appliances for easy care. Frequent cleaning of this product promotes hygiene and thus prevents harboring of bacteria as this product is machine washable and dryable. Accordingly, the chinrest cover is machine washable and dryable for easy maintenance.

In one embodiment, the chinrest cover excludes elastic bands.

In another embodiment, the chinrest cover comprises elastic bands. The elastic band comprises machine washable and dryable bands such as cotton braided bands.

In another embodiment, the chinrest cover can be of various shapes and sizes depending upon the chinrest model. Currently twenty models are commonly used. Accordingly, the chinrest cover has various designs including, but not limited to, teardrop, oblong, bean, half moon shapes etc.

In another embodiment, the chinrest cover provides protection without obstructing the musical performance.

Another embodiment is a method of preventing or protecting, or treating body parts such as chin, lower jaw, neck and collar bone, and skin thereof from diseases, conditions or allergies.

Another embodiment is a method of protecting the musical instrument or part thereof from deterioration.

Another embodiment is a method of making the chinrest covers, comprising sewing five to six parts into a chinrest cover.

The foregoing embodiments are not to be construed as limitations, but rather are presented as being representative.

Methods of Use

An embodiment of the invention is prevention or treatment of a disease of a condition in a musician resulting from the contact between the instrument and a body part of the musician.

In another embodiment, prevention or treatment of a disease of a condition in a musician resulting from the contact between the instrument and a body part of the musician, wherein the body part that is skin. Skin conditions are a significant problem for professional musicians of all ages and ability. Although usually not life threatening they may lead to impaired performance and occupational hazard. Unfortunately, epidemiological investigations have exclusively been performed on orchestra musicians, though the prevalence of skin condition in other musician groups, such as jazz and rock musicians, as well as amateur musicians is of interest as well (Önder et al., Stress and skin diseases in musicians: evaluation of the beck depression scale, general psychologic profile (the brief symptom inventory [BSI]), beck anxiety scale and stressful life events in musicians. *Biomed Pharmacother* 2000, 32:311-315; Nethercott et al., Dermatologic problems of musicians. *J Am Acad Dermatol* 1991, 25:870; Rimmer et al., Dermatologic problems of musicians. *J Am Acad Dermatol* 1990, 22:657-663; Önder et al., Skin problems of musicians. *Intl J Dermatol* 1999, 38:192-195).

The skin of the chin is important in the positioning and playing of a musical instrument such as violin or viola, because of an intense contact between the instrument and the musician's skin during the performance. It is, therefore, not surprising that most of the reported skin disorders of instrumental musicians include a variety of allergic contact sensitizations, in particular, to colophony, nickel, and exotic woods, and irritant skin conditions whose clinical appearance and localization are usually specific for the instrument used (e.g., "fiddler's neck"). Apart from common callosities and "occupational marks," severe skin injuries may occur, in particular acute and chronic wounds including their complications such as infection.

Fiddler's neck condition frequently affects violin and viola players. An area of lichenification and hyperpigmentation on the side of the neck below the angle of the jaw is usually observed in this skin disorder. Erythema, scaling, cyst and scar formation, papules and pustules, and focal neck edema may occur as well (Peachey et al., Fiddler's neck, *Br J Dermatol* 1978, 98:669-674; Stern, The edema of fiddler's neck. *J Am Acad Dermatol* 1979, 1:538-540; Lachappelle et al., Pseudofolliculitis of the beard and "fiddler's neck," *Contact Dermatitis* 1984, 10:4, 247). Recently, dystrophic calcinosis cutis in the skin below the mandible of a violinist has been described (Oga et al., Dystrophic calcinosis cutis in the skin below the mandible of a violinist. *Br J Dermatol* 1998, 139: 940-941). Histopathology of "fiddler's neck" frequently demonstrates hyperkeratosis, acanthosis and histiocytic infiltrates with presence of granulomas to foreign body and follicular cysts. Clinically, non-eczematous irritant contact dermatitis with granulomatous, acne-like appearance, persistent contact dermatitis and dermal irritant contact dermatitis may also be differentiated histopathologically from rosacea and sarcoid reaction with granuloma formation (Rietschel et al., eds, Fisher's contact dermatitis. Williams & Wilkins Baltimore 1995). Probably due to the particular location and relatively complex mechanism for causation of "fiddler's neck" the clinical appearance and histopathology of this skin condition show a wider spectrum of skin changes as compared to common irritant contact dermatitis (Buckley et al., 'Fiddler's fingers': violin-string dermatitis. *Contact Dermatitis* 1995, 32:46-47; Rietschel et al.). Some authors believe that this condition belongs to the range of acne mechanica (Brun et al., *Un acne mechanique ceconnue: la dermite du cou des violinistes. Ann Dermatol Venereol* 1984, 111:241-245). The aetiology is thought to be due to a combination of factors: friction giving rise to lichenification, while local pressure, shearing stress, and occlusion may play a part in producing acne-like lesions and cyst formation. Additionally poor hygiene may predispose to local infection. Viola players are believed to be more prone to develop "fiddler's neck" than violinists because the instrument itself is larger and heavier (Peachy et al.; Zina et al., Il "callo" del violista. *Giornale Ital Dermat e Venereol* 1981, 116:31).

Nickel, a common metal, is the most frequent contact sensitizer in the population at large. Nickel sensitivity has been observed in 4.5% in the general population, in 8% of females and 0.8% of males (Peltonen, Nickel sensitivity in the general population. *Contact Dermatitis* 1979, 5:27-32; Basketter et al., Nickel, cobalt and chromium in consumer products: a role in allergic contact dermatitis? *Contact Dermatitis* 1993, 28:15-25) and plays a role in contact dermatitis of musicians of the fingers and hands, as well as of the lip and neck area. Nickel contact dermatitis has been reported in string players (e.g., violinists, cellists, guitarists) and wind and brass instrumentalists such as flutists and trumpet players (Inoue et al., Flautist's chin. Br J Dermatol 1997, 136:147). The release of nickel from metal devices occurs due to friction, heat or galvanic factors and exposure to various bodily fluids including sweat and saliva. Consequently chronic mechanical irritation and maceration may not only cause irritant dermatitis but can also promote allergic contact eczema. Combined reactions to nickel, and chromium are not uncommon in the population at large and do present a simultaneous, distinct, and specific sensitization (Fiddler's neck. *Am J Contact Dermat* 1997, 8:39-42; Pencelli et al. Fiddler's neck and nickel dermatitis. *Contact Dermatitis* 1986, 13:37).

A variety of exotic woods are present in musical instruments and may cause allergic contact dermatitis (Hausen, Incidence and significance of toxic and allergic contact dermatitis caused by Macherium Scleroxylum Tul (Pao ferro), a substitute wood for palisander. *Hautarzt* 1982, 33:321-328). East Indian and Brazilian rosewood is used for manufacture of string and reed instruments such as violins, violas, guitars, recorders, and flutes. Makassar ebony and ebony woods are used for crafting violin and guitar fingerboards. Moreover Cocobolo wood and African blackwood are utilized for the production of recorder, oboe, and other reed instruments. Such woods may cause allergic contact dermatitis corresponding to the site of the wooden chinrest (Hausen et al. Contact allergy with a rosewood violin chinrest. *Derm Beruf Umwelt* 1979, 27:18-20; Haustein, Violin chinrest eczema due to east-Indian rosewood (*Dalbergia Latifolia* ROXB). *Contact Dermatitis* 1982, 8:77-78; Hausen et al. Cocobolo-Holz, ein vergessenes Ekzematogen? Neuere Erkenntnisse liber das Hauptallergen des Cocobolo-Holz (*Dalbergia* sp.). *Dermatosen* 1983, 31:110-117; Chinrest allergy in a violinist. Contact *Dermatitis* 1985, 12:178-180; Piletta et al., Allergic contact dermatitis to East Indian rosewood (*Dalbegia latifolia* Roxb.). *J Am Acad Dermatol* 1996, 34:298-300; Bork, Stigmas, symptoms and diseases of the skin in musicians. *Hautarzt* 1993, 44:574-580).

Skin eruptions on the neck caused by para-phenylenediamine allergy due to chinrests colored with a stain containing "Ursol-Echtschwarz", which consists of para-phenylenediamine, a common allergen with cross-reactivity to parabens, benzocaine, and sulfonamides (Bork, Allergic contact dermatitis on a violinist's neck from para-phenylenediamine in a chinrest stain. *Contact Dermatitis* 1993, 28:250-251).

An embodiment of the invention is a method of treatment or prevention of a skin condition or disease comprising a chinrest cover. The condition or disease is selected from the group consisting of allergic contact sensitizations, fiddler's neck, common callosities, lichenification, hyperpigmentation, erythema, scaling, cyst and scar formation, papules and pustules, and focal neck edema, dystrophic calcinosis cutis, hyperkeratosis, acanthosis, histiocytic infiltrates with presence of granulomas to foreign body, follicular cysts, chronic wounds, infection, dermatitis, resulting from use of musical instruments in musicians. In an embodiment of the invention, the cover made of fabric comprising bamboo fabric promotes optimum bacterial protection.

In another embodiment, the method of treatment comprises the chinrest cover comprising additives. The additives can be natural or synthetic, and include, but not limited to, minerals, vitamins, cosmetics, dermatologicals, pharmaceuticals, and supplements. The additives can be incorporated before, during or after the fabric preparation and/or cover preparation. The additives are selected based on the need of the instrumentalist, the skin condition, required treatment and available additives useful the purpose.

The foregoing methods are not to be construed as limitations, but rather are presented as being representative.

Methods of Manufacture

The invention can be made by the following exemplary methods, not to be construed as limitations, but rather are presented as being representative. All the possible methods that would be obvious to a person of ordinary skill in the art based on the following examples below should be considered as part of the specification and as such included in here.

EXAMPLES

Example 1

Guarneri Model (FIG. 6)

Figure 7A:
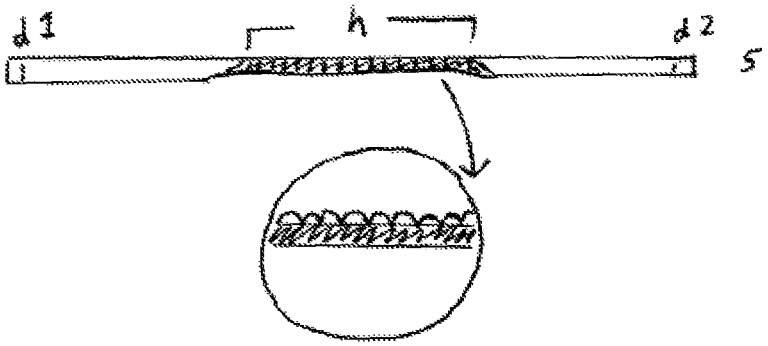
FIG. 7*a* Cotton braid elastic band.
Figure 7B:
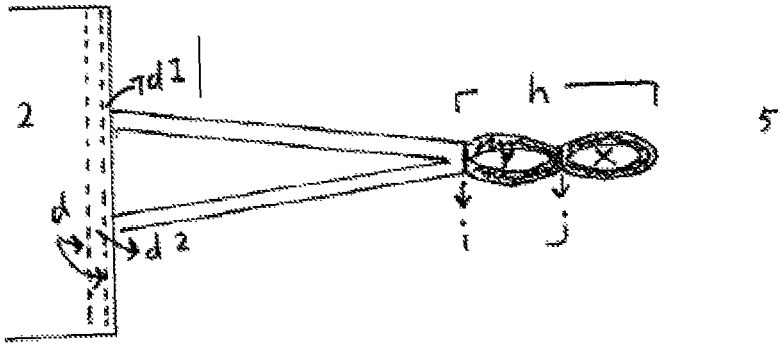
FIG. 7*b*. Elastic band's construction into two loops (x, y).

Patterns for parts 1-4 are traced with marker or chalk and cut out with scissors. FIG. 6 depicts the fabric's front side is facing up. Take 4 and fold the material on the edge of 4 twice (FIG. 22). Iron the fold and sew along a. Take 1 and 2. Align edge of material, putting front side of the fabric together along b. Sew along b on back side of the fabric. Iron the seam on front side of the fabric. 1 & 2 are sewn together as a front panel. Then take 3 and align edge of material, putting front side of the fabric together along 3*c* and 1 & 2*c*. Sew c on back side of the fabric and iron the seam on front side of the fabric. Now the front and the back panels are sewn together. Fold once along the sewn 2*d* & 3*d* and iron the fold. Then take 4 and place it on top of 3, front side of the fabric facing up and aligning 4*f* over 3*f*. Then fold 1 & 2 panel over 3 to face each other. Sew along e, f and g continuously on back side of the fabric. Flip inside out and iron along edges on front side of the cover. Take 5 and fold horizontally along h and hand sew along the edges with loop stitches (FIG. 7*a*). Fold that in half and bind the end thread of loop stitches at i. Use a thicker thread and secure a knot at j to create loop x and y (FIG. 7*b*). Place 5 in between 2*d* and 3*d*, aligning d1 and d2 before sewing double lines (FIG. 7*b*).

Example 2

Center Mount Left Cup Universal Cover (FIG. 6*b*)

Patterns for parts 1-4 are traced with marker or chalk and cut out with scissors. FIG. 6*b* depicts the fabric's front side is facing up. Take 4 and fold in 6, cotton braid elastic, aligning a. Machine sew along a. Take 1 and 2. Align edge of material, putting front side of the fabric together along b. Sew along b on back side of the fabric. Iron the seam on front side of the fabric. 1 & 2 are sewn together as a front panel. Then take 3 and align edge of material, putting front side of the fabric together along 3*c* and 1 & 2*c*. Sew c on back side of the fabric and iron the seam on front side of the fabric. Now the front and the back panels are sewn together. Fold once along the sewn 2*d* & 3*d* and iron the fold. Then take 4 and place it on top of 3, front side of the fabric facing up and aligning 4*f* over 3*f*. Then fold 1 & 2 panel over 3 to face each other. Sew along e, f and g continuously on back side of the fabric. Flip inside out and iron along edges on front side of the cover. Take 5 and fold horizontally along h and hand sew along the edges with loop stitches (FIG. 7*a*). Fold that in half and bind the end thread of loop stitches at i. Use a thicker thread and secure a knot at j to create loop x and y (FIG. 7*b*). Place 5 in between 2*d* and 3*d*, aligning d1 and d2 before sewing double lines (FIG. 7*b*).

Example 3

SAS Model (FIG. 19)

Patterns of parts 1-4 are traced with marker or chalk and cut out with scissors. FIG. 19 depicts the fabric's front side is facing up. Take 4 and fold the material on the edge of 4 twice (FIG. 22). Iron the fold and sew along a. Take 1 and 2. Align edge of material, putting front side of the fabric together along b. Sew along b on back side of the fabric. Iron the seam on front side of the fabric. 1 & 2 are sewn together as a front panel. Then take 3 and align edge of material, putting front side of the fabric together along 3*c* and 1 & 2*c*. Sew c on back side of the fabric and iron the seam on front side of the fabric. Now the front and the back panels are sewn together. Fold once along the sewn 2*d* & 3*d* and iron the fold. Then take 4 and place it on top of 3, front side of the fabric facing up and aligning 4*e* over 3*e*. Then fold 1 & 2 panel over 3 to face each other. Sew along e and f continuously on back side of the fabric. Flip inside out and iron along edges on front side of the cover. Take 5 and fold horizontally along h and hand sew along the edges with loop stitches (FIG. 7*a*). Fold that in half and bind the end thread of loop stitches at i. Use a thicker thread and secure a knot at j to create loop x and y (FIG. 7*b*). Place 5 in between 2*d* and 3*d*, aligning d1 and d2 before sewing double lines (FIG. 7*b*).

Example 4

Dresden Model (FIG. 11), Kaufman Model (FIG. 13)

Patterns of parts 1-4 are traced with marker or chalk and cut out with scissors. FIGS. 11 and 13 depicts the fabric's front side is facing up except 4/2. Take 4/2 and place it on top of 4/1 and machine sew along a. Iron the seam on front side of the fabric. Take 1 and 2. Align edge of material, putting front side of the fabric together along b. Sew along b on back side of the fabric. Iron the seam on front side of the fabric. 1 & 2 are sewn together as a front panel. Then take 3 and align edge of material, putting front side of the fabric together along 3*c* and 1 & 2*c*. Sew c on back side of the fabric and iron the seam on front side of the fabric. Now the front and the back panels are sewn together. Fold once along the sewn 2*d* & 3*d* and iron the fold. Then take the sewn 4/1 & 4/2, both front side of the fabric facing out, and place it on top of 3, aligning both 4/1 & 4/2 *f* over 3*f*. Then fold 1 & 2 panel over 3 to face each other. Sew along e, f and g continuously on back side of the fabric. Flip inside out and iron along edges on front side of the cover. Take 5 and fold horizontally along h and hand sew along the edges with loop stitches (FIG. 7*a*). Fold that in half and bind the end thread of loop stitches at i. Use a thicker thread and secure a knot at j to create loop x and y (FIG. 7*b*). Place 5 in between 2*d* and 3*d*, aligning d1 and d2 before sewing double lines (FIG. 7*b*).

Example 5

Left Mount Universal Cover (FIG. 13*b*)

Patterns of parts 1-4 are traced with marker or chalk and cut out with scissors. FIG. 13*b* depicts the fabric's front side is facing up. Take 4 and fold in 6, cotton braid elastic, aligning a. Machine sew along a. Iron the seam on front side of the fabric. Take 1 and 2. Align edge of material, putting front side of the fabric together along b. Sew along b on back side of the fabric. Iron the seam on front side of the fabric. 1 & 2 are sewn together as a front panel. Then take 3 and align edge of material, putting front side of the fabric together along 3*c* and 1 & 2 *c*. Sew c on back side of the fabric and iron the seam on front side of the fabric. Now the front and the back panels are sewn together. Fold once along the sewn 2*d* & 3*d* and iron the fold. Then take 4 and place it on top of 3, aligning 4*f* over 3*f*. Then fold 1 & 2 panel over 3 to face each other. Sew along e, f and g continuously on back side of the fabric. Flip inside out and iron along edges on front side of the cover. Take 5 and fold horizontally along h and hand sew along the edges with loop stitches (FIG. 7*a*). Fold that in half and bind the end thread of loop stitches at i. Use a thicker thread and secure a knot at j to create loop x and y (FIG. 7*b*). Place 5 in between 2*d* and 3*d*, aligning d1 and d2 before sewing double lines (FIG. 7*b*).

Example 6

Flesh Model (FIG. 15), Paganini Model (FIG. 17)

Patterns of parts 1-4 are traced with marker or chalk and cut out with scissors. FIGS. 15 and 17 depicts the fabric's front side is facing up except 4/2. Take 4/2 and place it on top of 4/1 and machine sew along a. Iron the seam on front side of the fabric. Take 1 and 2. Align edge of material, putting front side of the fabric together along b. Sew along b on back side of the fabric. Iron the seam on front side of the fabric. 1 & 2 are sewn together as a front panel. Then take 3 and align edge of material, putting front side of the fabric together along 3*c* and 1 & 2 *c*. Sew c on back side of the fabric and iron the seam on front side of the fabric. Now the front and the back panels are sewn together. Fold once along the sewn 2*d* & 3*d* and iron the fold. Then take the sewn 4/1 & 4/2, both front side of the fabric facing out, and place it on top of 3, aligning both 4/1 & 4/2*e* over 3*e*. Then fold 1 & 2 panel over 3 to face each other. Sew along e and f continuously on back side of the fabric. Flip inside out and iron along edges on front side of the cover. Take 5 and fold horizontally along h and hand sew along the edges with loop stitches (FIG. 7*a*). Fold that in half and bind the end thread of loop stitches at i. Use a thicker thread and secure a knot at j to create loop x and y (FIG. 7*b*). Place 5 in between 2*d* and 3*d*, aligning d1 and d2 before sewing double lines (FIG. 7*b*).

Example 7

Center Mount Universal Cover (FIG. 19*b*)

Patterns of parts 1-4 are traced with marker or chalk and cut out with scissors. FIG. 19*b* depicts the fabric's front side is facing up. Take 4 and fold in 6, cotton braid elastic, aligning a. Machine sew along a. Take 1 and 2. Align edge of material, putting front side of the fabric together along b. Sew along b on back side of the fabric. Iron the seam on front side of the fabric. 1 & 2 are sewn together as a front panel. Then take 3 and align edge of material, putting front side of the fabric together along 3*c* and 1 & 2 *c*. Sew c on back side of the fabric and iron the seam on front side of the fabric. Now the front and the back panels are sewn together. Fold once along the sewn 2*d* & 3*d* and iron the fold. Then take 4 and place it on top of 3, aligning 4*e* over 3*e*. Then fold 1 & 2 panel over 3 to face each other. Sew along e and f continuously on back side of the fabric. Flip inside out and iron along edges on front side of the cover. Take 5 and fold horizontally along h and hand sew along the edges with loop stitches (FIG. 7*a*). Fold that in half and bind the end thread of loop stitches at i. Use a thicker thread and secure a knot at j to create loop x and y (FIG. 7*b*). Place 5 in between 2*d* and 3*d*, aligning d1 and d2 before sewing double lines (FIG. 7*b*).

Example 8

Guarneri Model Chinrest Cover with Velcro® Attachment (FIGS. 21, 23*a*-23*d*)

Patterns of parts 1-4 are traced with marker or chalk and cut out with scissors. FIG. 21 depicts the fabric's front side is facing up. Take 3 and fold the material on the edge of 4 twice (FIG. 22). Iron the fold and sew along a. Sew in 4 b1, 4 b2, 4 b3, "loops" side of Velcro® on 2. Take 1 and align edge of material, putting front side of the fabric together along 1*c* and 2*c*. Sew c on back side of the fabric and iron the seam on front side of the fabric. Now the front and the back panels are sewn together. Fold the material on the edge of the sewn ld & 2*d* twice (FIG. 22) and iron the fold. Then take 3 and place it on top of 2, front side of the fabric facing up and aligning 3*f* over 2*f*. Then fold 1 on 2 to face each other. Sew along e, f and g continuously on back side of the fabric. Flip inside out and iron along edges on front side of the cover. Sew double lines at d.

What is claimed is:

1. A protective cover for chinrest for a musical instrument selected from the group consisting of violins and violas; wherein the protective cover comprises:

a first end comprising a front side and a back side pocket, the back side pocket being operable to receive a chinrest cup; and a second end comprising a fastener for attachment to the back of the instrument or to the leg of the chinrest;

wherein the protective cover comprises a fabric, the fabric being a hypo-allergenic and anti-bacterial fabric for optimum dermatological health, the fabric comprising bamboo or a combination of bamboo and cotton; and wherein the protective cover covers all parts of the chinrest that are in contact with the skin of the musician, thereby preventing the skin from contacting the chinrest.

2. The cover of claim 1, wherein the fastener is Velcro or cotton braid elastic band.

3. The cover of claim 2, wherein the fabric further comprises one or more fibers of either blended fabric or layered fabric; wherein the one or more fibers are selected from the group consisting of acrylic, polyester, rayon, ramie, nylon, silk, acetate, flax, polyester/cotton blends, polyester/cotton/spandex blends, bamboo/cotton blends, bamboo/spandex blends, bamboo/rayon blends, bamboo/cotton/rayon blends, bamboo/cotton/spandex blends, bamboo/rayon/spandex blends, or a mixture of two or more thereof.

4. The cover of claim 2, further comprises a shape, wherein the shape is teardrop, oblong, bean, or half moon.

5. The cover of claim 1, further comprising a mounting style comprising left mount, center mount left cup, or center mount center cup.

6. A method for treating or preventing a disease or a condition in a body part of a violist or violinist comprising chin, lower jaw, neck, collar bone and skin thereof resulting from direct contact with chinrest of a musical instrument selected from the group consisting of violins and violas; the method comprising:

providing the protective cover of claim 1 having hypo-allergenic and anti-bacterial fabric for optimum dermatological health;

covering the chinrest of the instrument with the protective cover;

preventing direct contact between the body part of the musician and the chinrest when playing the instrument; and thereby treating or preventing the disease or the condition.

7. The method of claim 6, wherein the condition or disease is selected from the group consisting of allergy, allergic contact sensitizations, fiddler's neck, common callosities, lichenification, hyperpigmentation, erythema, scaling, cyst and scar formation, papules and pustules, and focal neck edema, dystrophic calcinosis cutis, hyperkeratosis, acanthosis, histiocytic infiltrates with presence of granulomas to foreign body, follicular cysts, chronic wounds, infection, dermatitis, resulting from use of musical instruments in musicians.

8. The method of claim 7, wherein the allergic contact sensitization or allergy is selected from group consisting of metal allergy, wood allergy, paint allergy, and chemical allergy.

9. The method of claim 6, wherein the body part comprises is chin, lower jaw, neck, collar bone and skin thereof.

10. A device to treat or prevent a medical condition or disease, comprising the protective cover of claim 1.

11. A method of making the protective cover of claim 1 comprising:

a) selecting at least one hypo-allergenic and anti-bacterial fabric for optimum dermatological health, the at least one hypo-allergenic and anti-bacterial fabric comprising bamboo or a combination of bamboo and cotton;

b) using a pattern for a model from the group consisting of Guarneri model, SAS model, Dresden model, Kaufman model, Flesh model, and Paganini model;

c) tracing parts of the pattern on a fabric with a marker or chalk;

d) cutting out the parts;

e) aligning the parts, the aligning comprises aligning of edges of the fabric thereby placing front sides of the fabric together;

f) attaching the parts, the attaching comprises sewing; and g) ironing the protective cover.

12. A protective cover for chinrest for a musical instrument selected from the group consisting of violins and violas; the protective cover comprising:

a first end comprising a front side and a back side pocket , the back side pocket being operable to receive a chinrest cup; and a second end comprising a fastener for attachment to the back of the instrument or to the leg of the chinrest; and wherein the protective cover comprises a fabric, the fabric being a hypo-allergenic and anti-bacterial fabric for optimum dermatological health, the fabric comprising bamboo or a combination of bamboo and cotton;

wherein the shape of the cover is teardrop, oblong, bean, or half moon;

wherein the protective cover is mounted on the musical instrument comprising a mounting style comprising left mount, center mount left cup, or center mount center cup; and wherein the protective cover covers all parts of the chinrest that are in contact with the skin of the musician, thereby preventing the skin from contacting the chinrest.

13. The protective cover as in claim 12, wherein the cover treats or prevents a disease or a condition in the body part resulting from contact with the chinrest of the instrument, wherein the disease or a condition is a sensitization or allergy selected from group consisting of metal allergy, wood allergy, paint allergy, and chemical allergy.

14. A method of making a protective cover for chinrest for a musical instrument selected from the group consisting of violins and violas, the method comprising:

a) selecting at least one hypo-allergenic and anti-bacterial fabric for optimum dermatological health, the at least one hypo-allergenic and anti-bacterial fabric comprising bamboo or a combination of bamboo and cotton;

b) using a pattern for a model selected from the group consisting of Guarneri model, SAS model, Dresden model, Kaufman model, Flesh model, and Paganini model;

c) tracing parts of the pattern on the fabric with a marker or chalk;

d) cutting out the parts;

e) aligning the parts, the aligning comprises aligning of edges of the fabric thereby placing front sides of the fabric together;

f) attaching parts, the attaching comprises sewing ; and g) ironing the protective cover.

15. The protective cover prepared by the method of claim 14 comprising:

a first end comprising a front side and a back side pocket into which chinrest cup inserts; and a second end comprising at least one fastener member for attachment to the back of the instrument or to the leg of the chinrest;

wherein the protective cover comprises a fabric;

wherein the fabric is a hypo-allergenic and anti-bacterial fabric for optimum dermatological health, the fabric comprising bamboo or a combination of bamboo and cotton;

wherein the shape of the protective cover is teardrop, oblong, bean, or half moon;

wherein the protective cover is mounted on the musical instrument comprising a mounting style comprising left mount, center mount left cup, or center mount center cup; and wherein the protective cover covers all parts of the chinrest that are in contact with the skin of the musician, thereby preventing the skin from contacting the chinrest.

* * * * *